US008368279B2

(12) United States Patent
Rieker et al.

(10) Patent No.: US 8,368,279 B2
(45) Date of Patent: Feb. 5, 2013

(54) COMMUTATOR FOR AN ELECTRICAL MACHINE, AND ELECTRICAL MACHINE

(75) Inventors: Werner Rieker, Waldenbuch (DE); Ludwig Schoen, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 226 days.

(21) Appl. No.: 12/926,876

(22) Filed: Dec. 15, 2010

(65) Prior Publication Data

US 2011/0148247 A1 Jun. 23, 2011

(30) Foreign Application Priority Data

Dec. 15, 2009 (DE) ..... 10 2009 054 651

(51) Int. Cl.
*H01R 39/32* (2006.01)

(52) U.S. Cl. ..... 310/234; 310/233

(58) Field of Classification Search ..... 310/233–236, 310/128, 136, 216.011
See application file for complete search history.

(56) References Cited

U.S. PATENT DOCUMENTS

| | | | | |
|---|---|---|---|---|
| 3,777,367 | A * | 12/1973 | Kalagidis | 29/597 |
| 3,942,246 | A * | 3/1976 | Wilding | 29/597 |
| 4,760,301 | A * | 7/1988 | Iizima et al. | 310/233 |
| 5,008,577 | A * | 4/1991 | Wang | 310/233 |
| 5,440,800 | A * | 8/1995 | Terada et al. | 29/597 |
| 6,617,742 | B2 * | 9/2003 | Lau | 310/234 |
| 6,694,599 | B1 * | 2/2004 | Kershaw et al. | 29/597 |
| 6,979,922 | B2 * | 12/2005 | Simofi-Ilyes et al. | 310/90 |
| 7,772,739 | B2 * | 8/2010 | Nakano et al. | 310/233 |
| 2006/0261700 | A1 * | 11/2006 | Du et al. | 310/234 |

* cited by examiner

*Primary Examiner* — Thanh Lam
(74) *Attorney, Agent, or Firm* — Maginot, Moore & Beck

(57) ABSTRACT

The invention relates to a commutator for an electrical machine, having a commutator body on the outer circumference of which a plurality of electrically conductive, elongated laminations are disposed parallel to the longitudinal axis of the commutator. The laminations disposed adjacent to one another are electrically insulated from one another. The ends of the laminations, oriented toward the wire windings of an armature, are each electrically conductively connected to at least one wire end. According to the invention, it is provided that the ends of the laminations end, perpendicular to the longitudinal axis of the commutator, in planes offset from one another.

20 Claims, 7 Drawing Sheets

COMMUTATOR FOR AN ELECTRICAL MACHINE, AND ELECTRICAL MACHINE

CROSS-REFERENCE TO RELATED APPLICATION

This application is based on German Patent Application 10 2009 054 651.0 filed on Dec. 15, 2009.

BACKGROUND OF THE INVENTION

1. Field of the Invention

The invention relates to a commutator for an electrical machine.

2. Description of the Prior Art

One such commutator is already general prior art in a direct current motor, and has laminations disposed on a commutator body that are electrically contacted or connected, on the side toward one winding side of an armature, to the winding ends of the wire windings. As a result of the centrifugal forces engendered by the rotation of the armature, the connections between the wire ends or winding ends and the laminations must be embodied so as to be stable, even at relatively high rotary speeds of the armature.

It is therefore known for the ends, toward the wire windings, of the laminations to be bent over radially outward and back, so that the ends of the laminations point away from the wire windings. This hooklike embodiment of the lamination ends ensures a secure physical contact or in other words fastening of the winding ends on the lamination ends.

It is furthermore known for slots, in which the ends of the wire or winding can be placed, to be embodied on the laminations. By way of the winding ends, fixed in the slots in particular by soldered or welded connections, a secure connection can likewise be achieved. In commutators with slots on the lamination end, the maximum diameter of the winding wires is restricted by the width at the lamination end, or by the diameter of the lamination face. So that the winding wires can be connected securely to the laminations, additional provisions are therefore necessary. In commutators with hooklike lamination ends, and especially with a high number of laminations, the diameter of the commutator body and the disposition of the laminations are critical, in the sense that the ends of adjacent windings must be prevented from touching in the vicinity of the laminations, because that could lead to a short circuit between the affected windings.

One provision for reducing or preventing the problems discussed is to reduce the number of laminations, or to reduce the wire diameter of the windings. Another provision is to increase the diameter of the lamination face or to use a plurality of thinner, parallel-connected wires. However, all of these provisions can lead to unwanted properties of the electrical machine. For instance, the geometric replaceability of rotors or machines from the same series for different operating voltages can prove difficult. It is also conceivable that the service life of the carbon brushes and/or of the commutator will be shortened. Furthermore, heating of the windings, reduced efficiency, or running noise can occur. Because of the relatively high power density, these effects are more highly pronounced in relatively small electrical machines than in larger ones.

OBJECT AND SUMMARY OF THE INVENTION

With the prior art described as its point of departure, the object of the invention is to refine a commutator for an electrical machine, in such a way that while the diameter of the commutator is unchanged compared to the prior art, the use of relatively thick winding wires is made possible, without functional impairments or other worsening of the electrical properties of the electrical machine during assembly or operation.

The invention is based on the concept of creating additional free spaces or additional attachment spaces for the wire ends or winding ends by means of an offset arrangement of the various ends of the laminations, so that these ends, despite the use of relatively thick wires, can be connected to the applicable lamination without problems and without the risk that adjacent laminations or wires will touch.

In order in particular to keep the axial structural length of the commutator as short as possible, in a preferred refinement of the invention, it is provided that the ends of the laminations terminate in two planes parallel to one another, and that the ends of the laminations are disposed in alternation with one another as viewed in the circumferential direction, relative to the two planes.

For the sake of the largest possible area for contact of the wire ends with, or their attachment to, the laminations, it is provided in a further feature of the invention that the ends of the laminations are embodied in widened fashion.

A T-shaped embodiment of the ends, in particular, makes an interested arrangement of the laminations possible, so that the axial structural length of the commutator is made, only relatively slightly greater.

For securing the wire ends or winding ends, it is furthermore advantageous if securing slots for the wire ends are embodied in the ends. These securing slots can be used in particular for welding or soldering of the wire ends in the slots without thereby increasing the outside diameter of the commutator.

In order not to increase the outside diameter of the commutator, it is furthermore provided that the ends are radially aligned with the plane of the laminations.

In an alternative embodiment, it is also possible that the ends are embodied in hook-shaped fashion and are bent over radially outward. In this feature, it is possible in particular to dispense with the embodiment of slots or the like in the ends of the laminations, so that the manufacture of the laminations and of the commutator can be done relatively inexpensively.

Additional guidance of the wire ends and a secure electrical disconnection of adjacent wire ends is furthermore possible if the commutator body comprises plastic and is embodied as a shaped casting part, if the commutator body, on the side oriented toward the ends of the laminations, has guide zones for the wire ends, and if the guide zones are embodied as indented regions in the commutator body. As a result, the guide zones can be taken into account already during the production of the commutator body and therefore do not require an additional manufacturing step.

In these last-mentioned guide zones, it is furthermore especially advantageous if the wire ends of the windings disposed in the guide zones are fixed in the guide zones with a medium, in particular an adhesive, or a casting resin or a dribble resin.

The invention also includes an electrical machine, in particular a direct current motor, having a commutator of the invention. An electrical machine of this kind makes it possible, despite a relatively large wire diameter of the armature windings, to embody a commutator of relatively compact structure.

BRIEF DESCRIPTION OF THE DRAWINGS

The invention is described further in the ensuing detailed description of preferred embodiments taken in conjunction with the drawings, in which.

DESCRIPTION OF THE PREFERRED EMBODIMENTS

Figure 1:
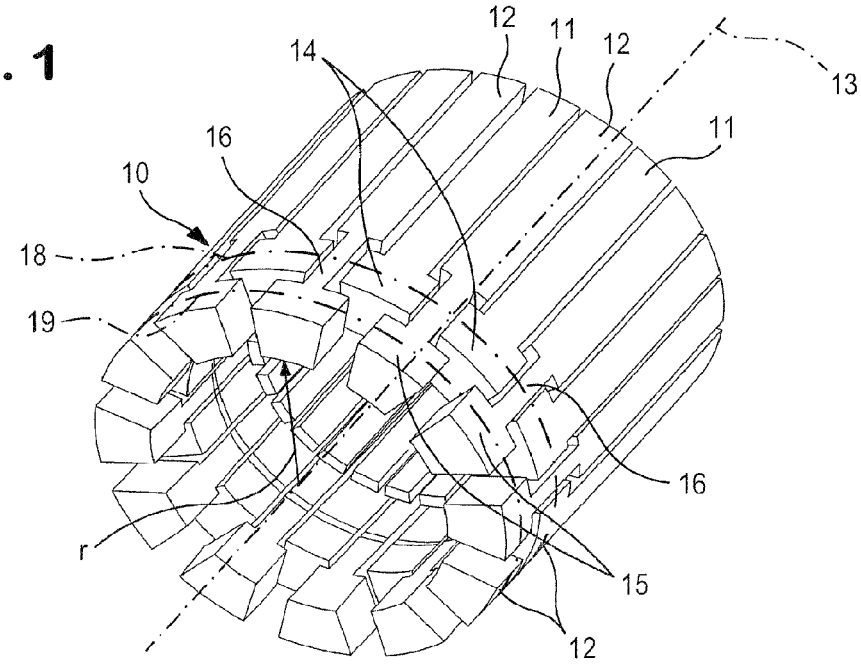
FIG. 1 is a perspective view on the arrangement of laminations of a commutator of the invention.

Identical components and components with the same function are provided with the same reference numerals in the drawings.

In FIG. 1, parts of a commutator 10 of the invention are shown, of the kind used in particular as components of an electrical machine, and especially preferably as components of a direct current motor.

In FIG. 1, a plurality of laminations 11 and 12 can be seen, spaced apart from one another at an identical radial spacing r from a longitudinal axis 13 of the commutator 10 and that form a common circumferential surface. The ends 14 and 15 of the laminations 11 and 12, which ends are disposed on the winding side of an armature, not shown in FIG. 1, are each embodied as T-shaped. In the case of the laminations 11, each of the laminations 11 has a constant width except for the ends 14, but the other laminations 12 have a portion 16 of reduced width. The T-shaped ends 14 of the first group of laminations 11 are disposed in the portions 16 of reduced width of the other group of laminations 12.

It is essential to the invention that the laminations 11 and 12, and the ends 14 and 15, alternate with one another as viewed in the circumferential direction of the commutator 10, so that one group of ends 14 terminate in a first plane 18 perpendicular to the longitudinal axis 13 of the commutator 10, while the other ends 15 of the laminations 12 terminate in a second plane 19, which is likewise disposed perpendicular to the longitudinal axis 13 of the commutator 10. Since the two planes 18 and 19 are disposed parallel to one another, one plane 18 is spaced apart farther on the winding side of the armature from the windings of the armature than the other plane 19.

Figure 2:
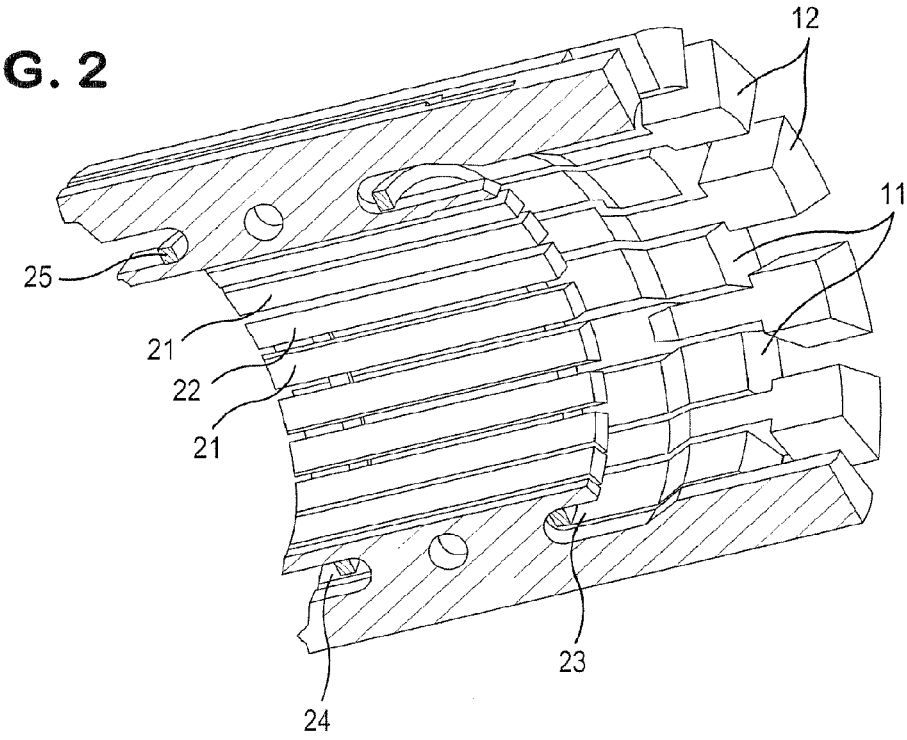
FIG. 2 is a sectional view of the arrangement in FIG. 1, to show the interior region of the laminations of the commutator.
Figure 3:
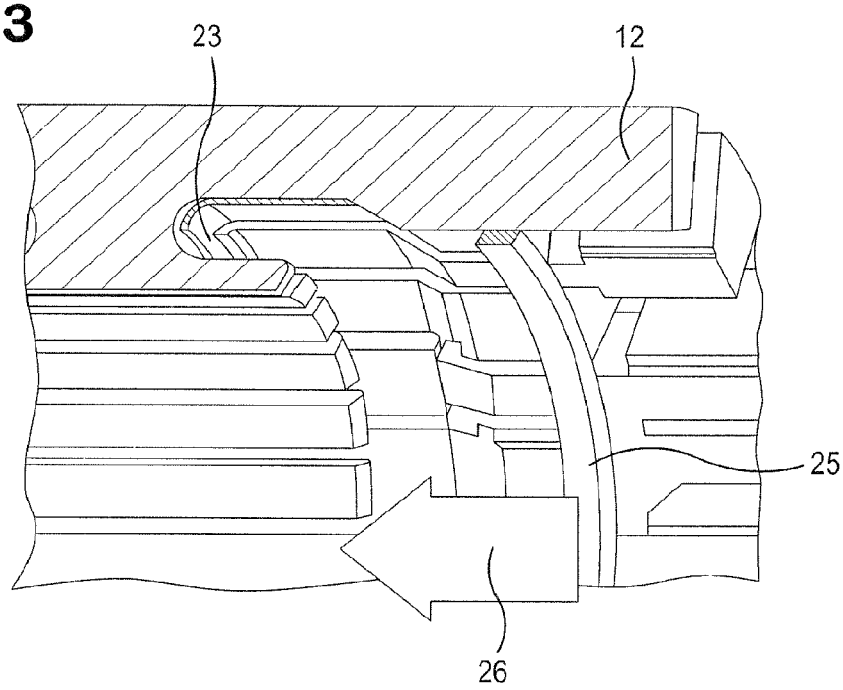
FIG. 3 shows a detail of FIG. 2, to illustrate the disposition of a reinforcing ring.

In FIG. 2, a partly sectional view of the arrangement of laminations 11 and 12 is shown, in which it can be seen that these laminations, on their inside oriented toward the longitudinal axis 13, each have riblike portions 21, 22, which on sides facing away from one another form pockets 23 and 24. The pockets 23 and 24 serve to receive reinforcing rings 25 in particular, which serve to stiffen and radially secure the laminations 11 and 12. For the sake of simpler introduction or insertion of the reinforcing rings 25 in the assembly direction indicated by the arrow 26, it is advantageous if the inside circumference of the pockets 23, 24 is larger than the outside diameter of the reinforcing rings 25.

A structural unit completed to this point, comprising the laminations 11 and 12 and optionally the reinforcing rings 25, is placed in a tool, not shown in the drawings, which serves to embody a commutator body 27, shown in particular in FIGS. 4 through 7. The commutator body 27 here comprises plastic in particular and is formed by an injection-molding or casting process.

Figure 4:
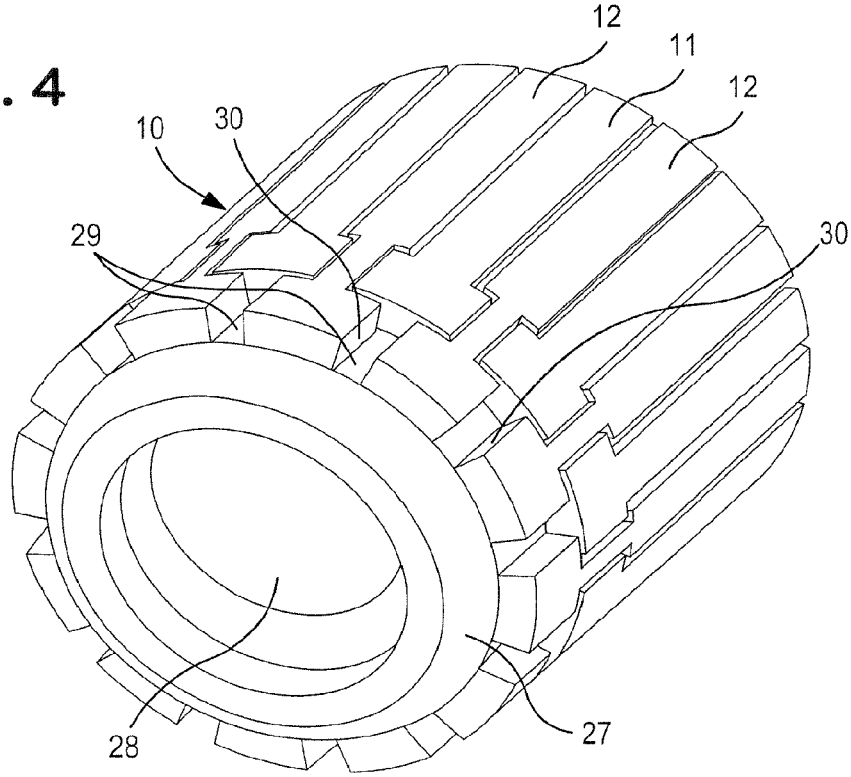
FIGS. 4 and 5 show a perspective view of a commutator body with its laminations during different manufacturing steps.
Figure 5:
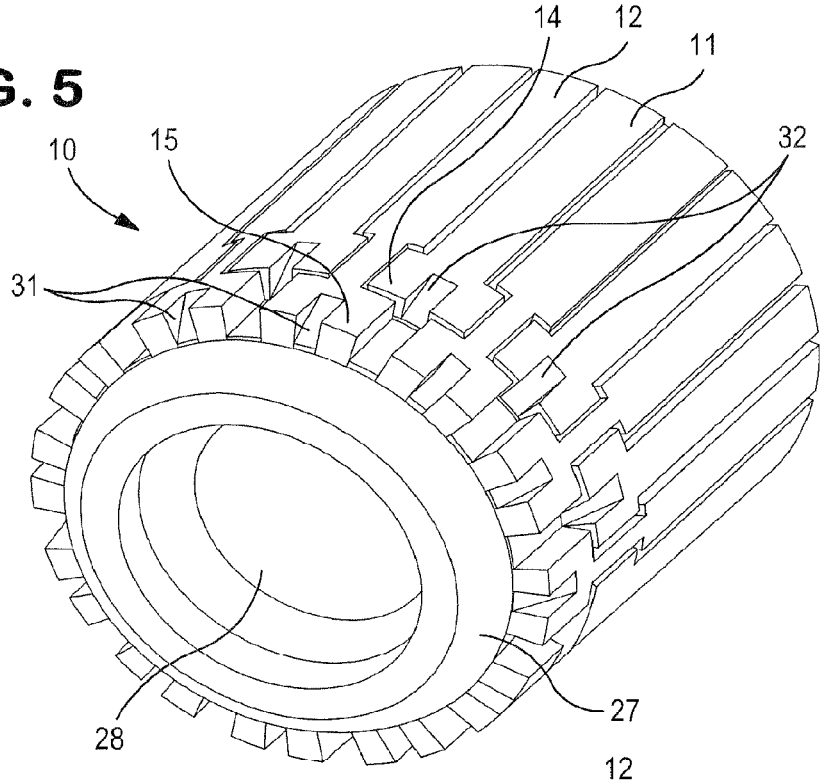

As can be seen from FIGS. 4 and 5, the commutator body 27 has a continuous longitudinal bore 28, so that the commutator body 27 can in particular be press-fitted onto an armature shaft or in other words connected to an armature shaft in a manner fixed against relative rotation.

In FIG. 4, a first method for manufacturing the commutator 10 and the commutator body 27 is shown, in which a free space 29 for guiding a winding wire in the direction toward the laminations 11 is embodied between each of the group of laminations 12; the free spaces 29 are bounded laterally by plastic material 30, in order to electrically insulate the wire, located in the respective free space 29, from the laminations 12. The free spaces 29 are taken into account by means of a suitable design of the tool for creating the commutator body 27.

In FIG. 5, the commutator 10 is shown after a further manufacturing step, in which a fixation slot 31, 32, extending diagonally in the exemplary embodiment, is embodied in each of the ends 14 and 15 of the laminations 11 and 12 by means of an embossing or milling operation. It will also be noted that the fixation slot 31, 32 can be embodied or disposed differently instead.

Figure 6:
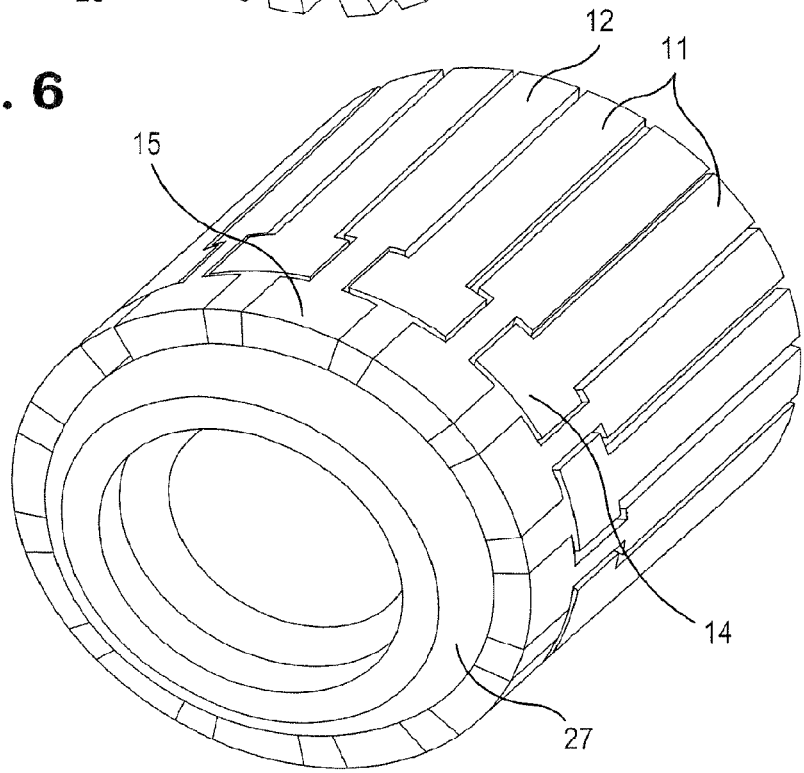
FIGS. 6 and 7 are views corresponding to FIGS. 4 and 5, in a second, modified manufacturing sequence.
Figure 7:
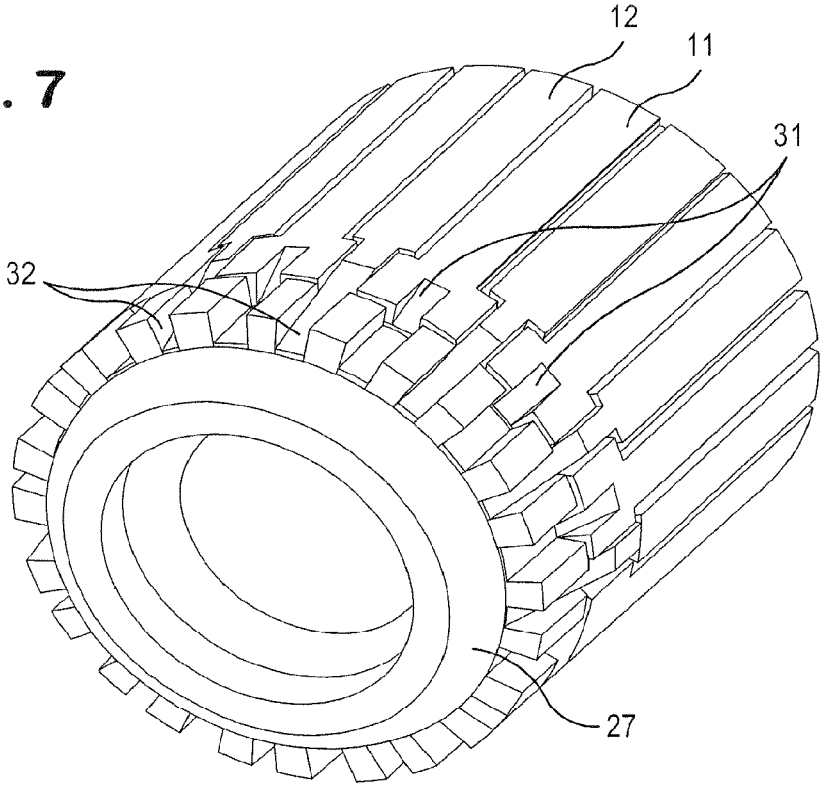

In FIGS. 6 and 7, an alternative production process for the commutator body 27 is shown. Here, after the spray-coating or embodiment of the commutator body 27 in accordance with FIG. 6, the entire space between the laminations 11 and 12 in the vicinity of their ends 14 and 15 is first injected or filled with plastic. Next, as shown in FIG. 7, in a single manufacturing step, both the free spaces 29 and the fixation slots 31 and 32 are made simultaneously, in particular by milling.

Figure 8:
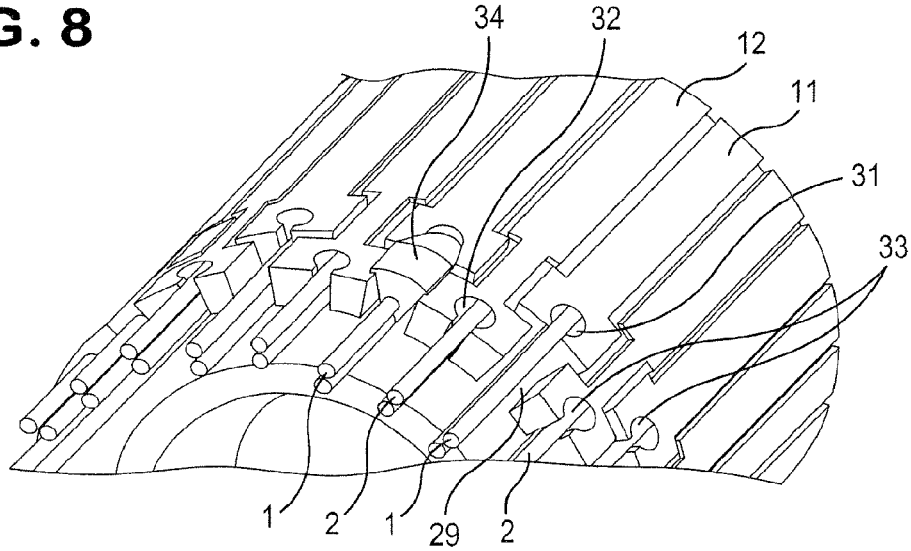
FIG. 8 is a perspective view on the commutator, showing the commutator with electrical contact provided by wire ends.
Figure 9:
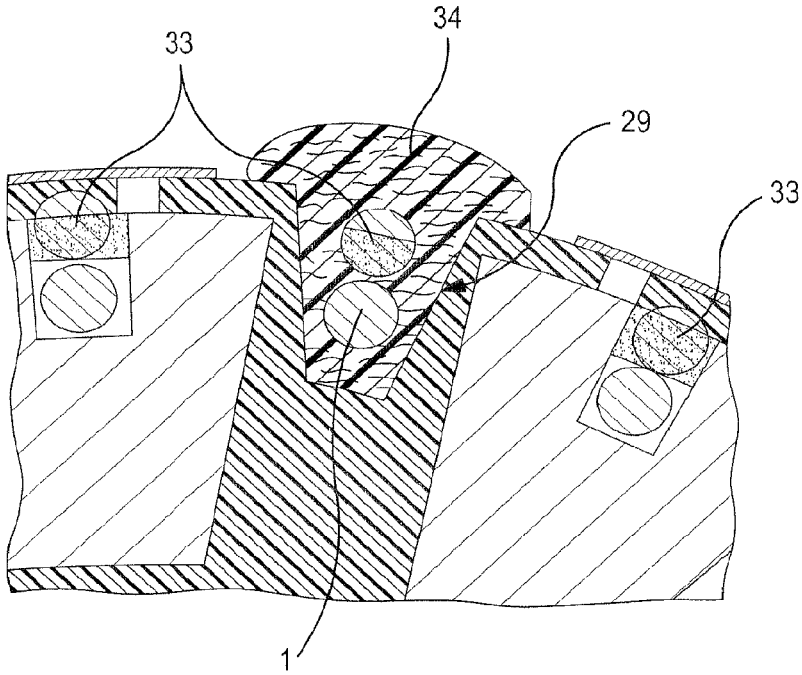
FIG. 9 is a detail of FIG. 8 in the vicinity of the connection point to the wire ends.
Figure 10:
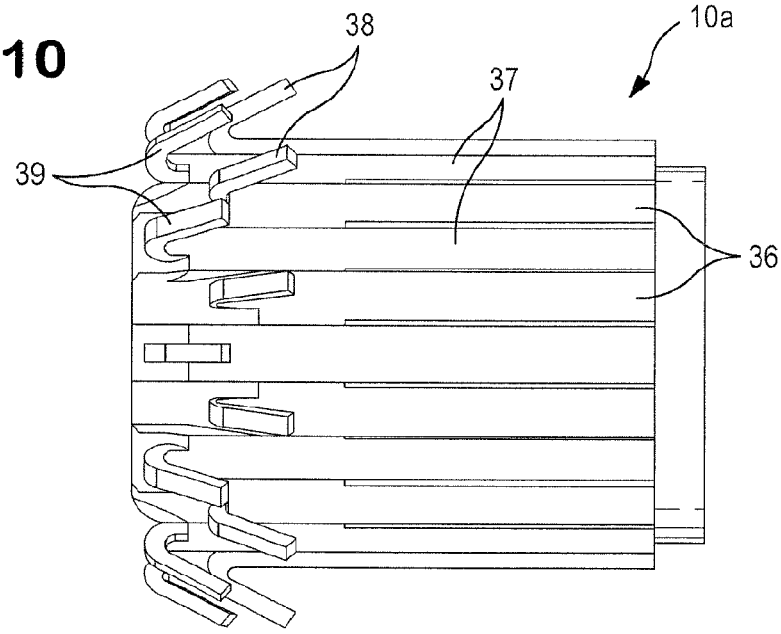
FIGS. 10 and 11 show a second commutator of the invention in perspective views.
Figure 11:
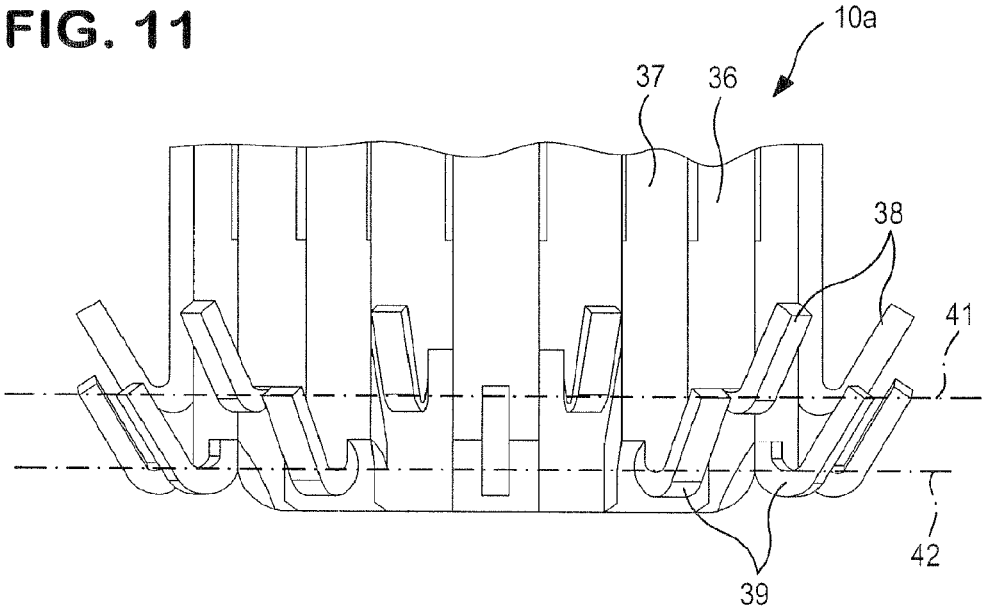

In FIG. 8, the situation is shown in which the wire ends 1 and 2 of the windings of the armature are disposed in the fixation slots 31 and 32 and in the free spaces 29. The connection between the wire ends 1 and 2 in the vicinity of the fixation slots 31 and 32 is effected in particular by means of a welded or soldered connection 33, while the wire ends 2 in the free spaces 29 are additionally secured or fixed by means of a medium 34, such as an adhesive, or a casting resin or a dribble resin.

In FIGS. 10 through 14, a modified commutator 10*a* is shown. What is essential here is that on the side oriented toward the wire ends 1 and 2, its laminations 36, 37 are bent over radially outward in hooklike fashion. The ends 38 and 39 of the laminations 36 and 37, viewed in the axial direction of the commutator 10*a*, protrude away from the wire ends 1 and 2, so that they form a radial securing means for the wire ends 1 and 2. As can be seen particularly from FIG. 11, the group of ends 38 of the laminations 36 is disposed at the level of a first plane 41, while the other ends 39 of the laminations 37 are disposed in the vicinity of a second plane 42. The second plane 42 has a lesser spacing from the wire ends 1 and 2 than the first plane 41 does.

Figure 12:
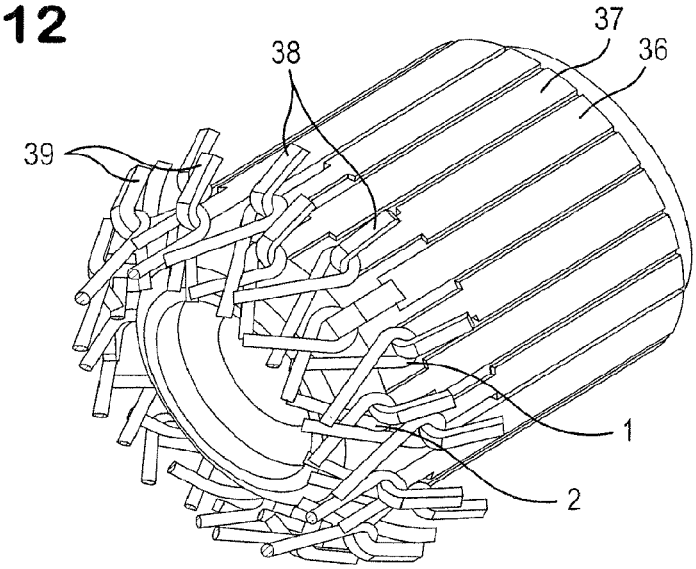
FIG. 12 shows the commutator of FIGS. 10 and 11 with connected wire ends, in a perspective view.
Figure 13:
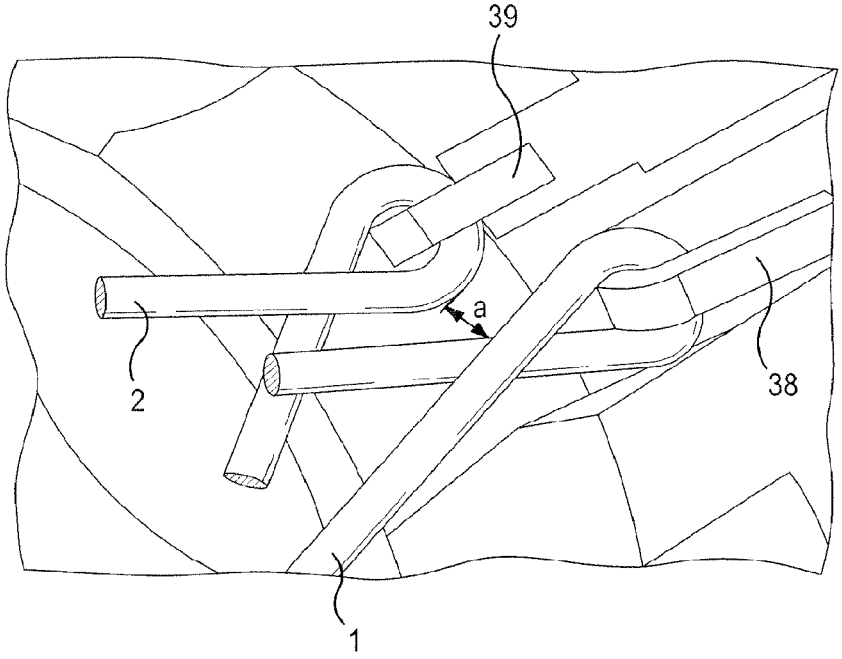
FIG. 13 shows a detail of the attachment of the wire ends of FIG. 12, in a perspective view.

In FIGS. 12 and 13, it is shown how the wire ends 1 and 2 are wrapped in looplike fashion around the ends 38 and 39 of the laminations 36 and 37. As can be seen particularly from FIG. 13, a spacing a is embodied between the wire ends 1 and 2 and separates the wire ends 1 and 2 spatially and thus also disconnects them electrically from one another; the size of the spacing a is determined by the axially offset arrangement of the ends 38 and 39 and by the looplike course of the wire ends 1 and 2 around the ends 38 and 39.

Figure 14:
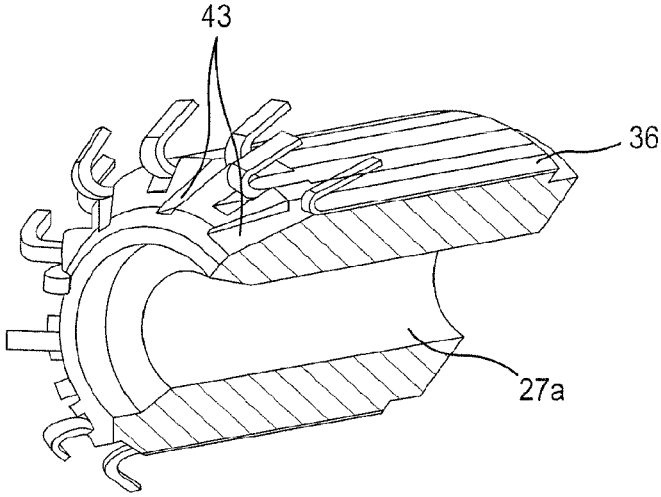
FIG. 14 shows a commutator of FIGS. 10 and 11, partly in section, to illustrate the guide zones in the commutator body.

Particularly in FIG. 14, guide zones 43 for the laminations 36 can also be seen, which are embodied in the commutator body 27*a* in order to better guide and stabilize the wire ends 1. By this provision, at the same time the winding head of the rotor winding can be reduced in its outside diameter, because the wire ends, viewed radially, are now located at a lower level.

It will additionally be noted that in the vicinity of the ends 38 and 39, the connection between the wire ends 1 and 2 in the commutator 10*a* is again preferably done by means of a soldered or welded connection 33 (not shown). Also in the commutator 10*a*, as in the commutator 10, it is understood that reinforcing rings 25 may also be provided.

The commutators 10, 10*a* described thus far can be modified in manifold ways, without departing from the concept of the invention. This concept is an offset embodiment, viewed in the axial direction of the commutator 10, 10*a*, of the ends 14, 15 and 38, 39 of the laminations 11, 12 and 36, 37, respectively, and this embodiment provides a relatively large space for securing the wire ends 1 and 2. Thus in particular, instead of two planes 18, 19 and 41, 42, it is also possible to provide more planes than that for the lamination ends. The number is limited solely by the possible axial length of the commutator 10, 10*a* and the structural length of the armature.

The foregoing relates to preferred exemplary embodiments of the invention, it being understood that other variants and embodiments thereof are possible within the spirit and scope of the invention, the latter being defined by the appended claims.

We claim:

1. A commutator for an electrical machine, having a commutator body on whose outer circumference a plurality of electrically conductive, elongated laminations are disposed parallel to the longitudinal axis of the commutator, the commutator body therein having laminations disposed adjacent to one another which are electrically insulated from one another, and ends of the laminations, oriented toward the wire windings of an armature, are each electrically conductively connected to at least one wire end, wherein the ends of the laminations terminate, perpendicular to the longitudinal axis of the commutator, in planes offset from one another.

2. The commutator as defined by, claim 1, wherein the ends of the laminations terminate in two planes parallel to one another and the ends of the laminations are disposed in alternation with one another, as viewed in a circumferential direction, relative to the two plans.

3. The commutator as defined by claim 1, wherein the ends of the laminations are embodied as widened compared to the laminations.

4. The commutator as defined by claim 2, wherein the ends of the laminations are embodied as widened compared to the laminations.

5. The commutator as defined by claim 3, wherein the ends of the laminations are embodied as T-shaped.

6. The commutator as defined by claim 4, wherein the ends of the laminations are embodied as T-shaped.

7. The commutator as defined by claim 3, wherein securing slots for wire ends are embodied in the ends of the laminations.

8. The commutator as defined by claim 4, wherein securing slots for wire ends are embodied in the ends of the laminations.

9. The commutator as defined by claim 5, wherein securing slots for wire ends are embodied in the ends of the laminations.

10. The commutator as defined by claim 6, wherein securing slots for wire ends are embodied in the ends of the laminations.

11. The commutator as defined by claim 3, wherein the ends of the laminations are radially aligned with the plane of the laminations.

12. The commutator as defined by claim 5, wherein the ends of the laminations are radially aligned with the plane of the laminations.

13. The commutator as defined by claim 7, wherein the ends of the laminations are radially aligned with the plane of the laminations.

14. The commutator as defined by claim 1, wherein the ends of the laminations are embodied in hook-shaped fashion and are bent over themselves radially outward.

15. The commutator as defined by claim 2, wherein the ends of the laminations are embodied in hook-shaped fashion and are bent over themselves radially outward.

16. The commutator as defined by claim 1, wherein the commutator body comprises plastic and is embodied as a shaped casting part, the commutator body, on the side oriented toward the ends of the laminations, has guide zones for wire ends, and the guide zones are embodied as indented regions in the commutator body.

17. The commutator as defined by claim 2, wherein the commutator body comprises plastic and is embodied as a shaped casting part, the commutator body, on the side oriented toward the ends of the laminations, has guide zones for wire ends, and the guide zones are embodied as indented regions in the commutator body.

18. The commutator as defined by claim 16, wherein the wire ends disposed in the guide zones are fixed in the guide zones with a medium, in particular an adhesive, or a casting resin or a dribble resin.

19. The commutator as defined by claim 17, wherein the wire ends disposed in the guide zones are fixed in the guide zones with a medium, in particular an adhesive, or a casting resin or a dribble resin.

20. An electrical machine, in particular a direct current motor, having a commutator as defined by claim 1.

* * * * *